US011434773B2

(12) United States Patent
Nobelen

(10) Patent No.: US 11,434,773 B2
(45) Date of Patent: Sep. 6, 2022

(54) SECONDARY FLOW RECTIFIER WITH INTEGRATED PIPE

(71) Applicant: SAFRAN AIRCRAFT ENGINES, Paris (FR)

(72) Inventor: Florent Matthieu Jacques Nobelen, Moissy-Cramayel (FR)

(73) Assignee: SAFRAN AIRCRAFT ENGINES, Paris (FR)

( * ) Notice: Subject to any disclaimer, the term of this patent is extended or adjusted under 35 U.S.C. 154(b) by 0 days.

(21) Appl. No.: 17/438,648

(22) PCT Filed: Mar. 12, 2020

(86) PCT No.: PCT/FR2020/050524
§ 371 (c)(1),
(2) Date: Sep. 13, 2021

(87) PCT Pub. No.: WO2020/188197
PCT Pub. Date: Sep. 24, 2020

(65) Prior Publication Data

US 2022/0186624 A1 Jun. 16, 2022

(30) Foreign Application Priority Data

Mar. 15, 2019 (FR) ..... 1902662

(51) Int. Cl.
*F03B 1/00* (2006.01)
*F01D 9/04* (2006.01)

(52) U.S. Cl.
CPC ..... *F01D 9/041* (2013.01)

(58) Field of Classification Search
CPC ..... F05D 2220/323; F05D 2220/36; F01D 5/146; F04D 19/002; F04D 29/544; F02K 3/06

(Continued)

(56) References Cited

U.S. PATENT DOCUMENTS 2,798,661 A * 7/1957 Willenbrock, Jr. ..... F02C 7/04 415/209.1
6,502,383 B1 * 1/2003 Janardan ..... F02K 1/46 60/264

(Continued)

FOREIGN PATENT DOCUMENTS

GB 2546422 A 7/2017

OTHER PUBLICATIONS

French Search Report dated Jan. 17, 2020 in French Application No. 1902662.

(Continued)

*Primary Examiner* — Long T Tran
*Assistant Examiner* — James J Kim
(74) *Attorney, Agent, or Firm* — Sughrue Mion, PLLC

(57) ABSTRACT

The invention relates to an assembly for a turbomachine extending along an axis (X) and comprising: —a ferrule (32) designed to define a fan duct (5) of a gas stream of the turbomachine, —a fan casing (2) radially surrounding the ferrule (32) and defining with the ferrule (32) the fan duct (5), —a rectifier (6) comprising a plurality of vanes (7) comprising a first vane (7*a*) and a second vane (7*b*) adjacent to the first vane (7*a*), the vanes defining between them a converging flow channel (13) designed to direct and accelerate the stream by means of an inlet section (14*a*) included in a plane non-perpendicular to the axis of the turbomachine and an outlet section included in a plane (14*b*) perpendicular to the axis (X) of the turbomachine, the first vane (7*a*) and the second vane (7*b*) each having an unducted downstream portion which forms a trailing edge.

9 Claims, 3 Drawing Sheets

(58) Field of Classification Search
USPC ..... 415/208.1
See application file for complete search history.

(56) References Cited

U.S. PATENT DOCUMENTS

| | | | | |
|---|---|---|---|---|
| 7,604,458 | B2 * | 10/2009 | Ishii | F04D 29/544 415/218.1 |
| 9,759,234 | B2 * | 9/2017 | Domereq | F04D 29/666 |
| 2009/0056306 | A1 | 3/2009 | Suciu et al. | |
| 2018/0038235 | A1 * | 2/2018 | Damevin | F04D 29/667 |
| 2021/0199019 | A1 * | 7/2021 | Wallin | F01D 17/141 |

OTHER PUBLICATIONS

International Search Report dated Oct. 15, 2020 in International Application No. PCT/FR2020/050524.
Written Opinion of the International Searching Authority dated Oct. 15, 2021 in International Application No. PCT/FR2020/050524.

* cited by examiner

SECONDARY FLOW RECTIFIER WITH INTEGRATED PIPE

CROSS REFERENCE TO RELATED APPLICATIONS

This application is a National Stage of International Application No. PCT/FR2020/050524 filed Mar. 12, 2020, claiming priority based on French Patent Application No. 1902662 filed Mar. 15, 2019, the entire contents of each of which being herein incorporated by reference in their entireties.

GENERAL TECHNICAL FIELD AND PRIOR ART

The field of the invention relates to multiple flow turbomachines, and more precisely the flow straighteners of a turbomachine with multiple separate flows.

A multiple flow turbomachine as illustrated in FIG. 1 conventionally includes a fan 1, a fan shroud 2 and a casing 3 extending along a longitudinal axis X.

The casing 3 houses the compression, combustion and expansion elements of the turbomachine.

The fan shroud 2 extends radially outside the fan 1 and the casing 3 so as to delimit the flow entering the fan 1.

The fan 1 compresses and accelerates the flow of air entering the fan shroud 2, this flow of air then circulating in a primary circuit 4 and a secondary circuit 5, the primary circuit 4 being located inside the casing 3 and passing through the different compression, combustion and expansion element, the secondary circuit 5 being delimited radially inside by the casing 3 and outside by the fan shroud 2.

The rotation of the fan 1 inducing a swirl in the flow that it accelerates, it is known to position a flow straightener 6 in the secondary circuit 5, the straightener 6 including a plurality of vanes 7 configured to modify the direction of circulation of the flow in order to obtain axial flow downstream of the straightener 6.

The profile of the nacelles 2 is conventionally configured to form a nozzle downstream of the straightener and to accelerate and expand the secondary flow so as to generate the thrust, the cross section of the secondary circuit 5 decreasing downstream (in the case of a converging nozzle), then possibly re-increasing in the case of a converging-diverging nozzle.

In a turbomachine with separate flows, each flow is ejected by a nozzle. The nozzle (primary and secondary) transforms the potential energy into kinetic energy, i.e. it converts the pressure of the flow into ejection speed, which will generate thrust.

The secondary flow nozzle surrounds and is conventionally placed upstream of the primary flow nozzle. The primary flow nozzle is delimited by a cone, the point of which is directed downstream, and by an annular casing having a trailing edge oriented downstream. The cone and the casing define a circuit with a converging or converging-diverging section depending on the architecture selected.

The secondary nozzle is delimited by a duct belonging to the fan shroud (commonly called OFD or OFS, an abbreviation of "Outer Fan Duct/Shroud") and to the turbomachine casing (currently called IFD or IFS, an abbreviation of "Inner Fan Duct/Shroud"). The two casings define a converging or converging-diverging section depending on the architecture of the rest of the engine.

This reduction of cross section is conventionally located downstream of the straightener 6, so as to accelerate the secondary flow as it streams axially, the secondary flow then being ejected around the primary flow.

In order to improve propulsive efficiency, it is desired to maximize the bypass ratio, i.e. the ratio of the mass flow rates of the secondary flow and of the primary flow, and therefore to minimize the compression ratio of the fan 1 for a given thrust.

The increase of the bypass ratio increases the diameter of the fan for the same thrust, which causes an increase in the volume and the weight of the fan shroud. Therefore, to limit this disadvantage, it is desired to reduce the fan shroud 2 to its strict minimum, in order to reduce its mass and the head losses of the secondary circuit 5, the effect of the head losses on the secondary flow being greater as the flow rate is greater, necessary for a high bypass ratio, and the pressure low, necessary for a low compression ratio of the fan 1.

Thus, the air inlet must be extremely short, and the fan shroud 2 must be as short as possible after the outlet of the blades 7 of the straightener 6.

GENERAL PRESENTATION OF THE INVENTION

One goal of the invention is to reduce the head losses induced by the fan shroud.

Another goal of the invention is to accelerate the secondary flow.

Another goal is to limit the head losses induced by the straightener.

Another goal of the invention is to increase the bypass ratio of the turbomachine.

Another goal is to reduce the compression ratio of the fan.

In order to achieve this, the invention proposes an assembly for a turbomachine extending along an axis and comprising:

- a ferrule configured to delimit a fan duct of a gas flow of said turbomachine,
- a fan shroud, radially surrounding the ferrule and delimiting, with the ferrule, the fan duct,
- a straightener comprising a plurality of vanes configured to straighten a secondary flow circulating in the fan duct, in which the plurality of vanes comprises a first vane and a second vane adjacent to the first vane, delimiting between them a converging stream channel configured to straighten and accelerate the flow by means of an inlet section comprised in a plane that is not perpendicular to the axis of the turbomachine and an outlet section comprised in a plane perpendicular to the axis of the turbomachine, the first vane and the second vane each having a downstream unducted portion forming a trailing edge.

This allows straightening and accelerating the flow propelled by the fan and transiting in a stream channel.

Advantageously, the invention can be completed by the following features, taken alone or in combination:

- the stream channel comprises, from upstream to downstream, an intake portion narrowing from upstream to downstream and an ejection portion widening from upstream to downstream;
- the first vane has a first surface, the second vane has a second surface facing the first surface, the first surface approaching the second surface from upstream to downstream;
- the fan shroud extends around a longitudinal axis and comprises a downstream end forming a trailing edge, and in which the ejection portion extends downstream of the trailing edge of the fan shroud; this allows slowing the flow in the ejection portion until the flight speed;

a camber line of each vane has an inflection point;

each vane comprises a leading edge, a trailing edge opposite to the leading edge, and pressure side and suction side walls connecting the leading edge to the trailing edge, and the stream channel has, from upstream to downstream in the stream direction of the fluids, an inlet section extending from the first vane to the second vane while being normal to a mean stream direction and tangent to the leading edge of one of the vanes and having a first area, an ejection section extending from the first vane to the second vane while being normal to a mean stream direction and having a second area, and an outlet section extending from the first vane to the second vane while being normal to a mean stream direction and tangent to the trailing edge of at least one of the vanes and having a third area, the first area being greater than the second area, the second area being less than the third area;

the stream channel has an inlet section defining a plane normal to the stream direction of the flow deflected by the fan, which is not parallel to the axis of the turbomachine, and an ejection section defining a plane normal to the axis of the turbomachine;

the fan shroud continues axially beyond the median plane, the trailing edge of the fan shroud being located downstream of the median plane and upstream of the trailing edges of the vanes, at a duct plane.

This allows accelerating the flow in a first portion of the stream channel, then slowing the flow in a second portion of the stream channel.

According to another aspect, the invention proposes a turbomachine including an assembly of this type.

PRESENTATION OF THE FIGURES

Other features and advantage of the invention will be revealed by the description that follows, which is purely illustrative and not limiting, and must be read with reference to the appended figures in which.

DESCRIPTION OF ONE OR MORE MODES OF IMPLEMENTATION AND EMBODIMENTS

Figure 1:
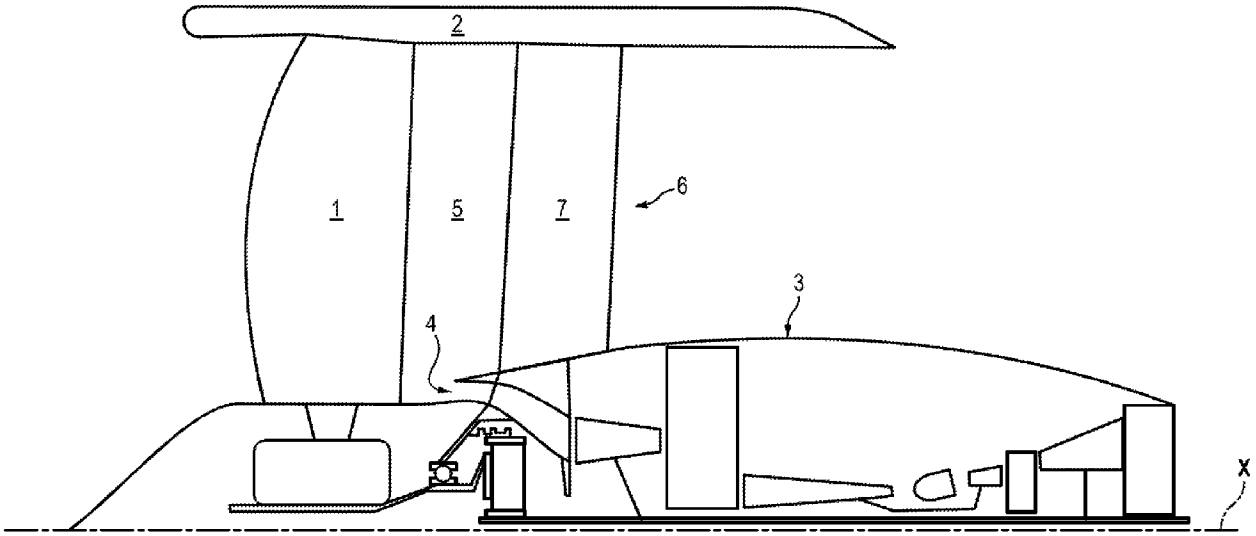
FIG. 1 is a schematic profile section view of a turbomachine including a nacelle and a secondary flow straightener according to the prior art.

The invention applies to a turbomachine comprising:

a ferrule 32 configured to internally delimit a fan duct 5 of a gas flow of said turbomachine, a fan shroud 2, radially surrounding the ferrule 32 and delimiting with the ferrule 32 the fan duct 5, a straightener 6 comprising a plurality of vanes 7 configured to straighten a secondary flow circulating in the fan duct 5, in which the plurality of vanes 7 comprises a first vane 7*a* and a second vane 7*b* adjacent to the first vane 7*a*, delimiting between them a stream channel 13, the first vane 7*a* and the second vane 7*b* being configured to straighten and accelerate the flow circulating in the stream channel 13.

The flow thus circulating in the straightener 6 is accelerated in such a manner that it is no longer necessary to form a nozzle downstream of the straightener 6 between the fan shroud 2 and the ferrule 32.

It is therefore possible to significantly shorten the fan shroud 2, and therefore to reduce its mass, or to allow an increase of its diameter while retaining a mass substantially similar to a fan shroud 2 of the prior art.

This also allow reducing the head losses caused by the fan shroud 2.

In the entire text of this application, the notions of upstream and downstream are defined in the direction of the gas stream in the turbomachine.

The turbomachine extends along a turbomachine axis X, and the terms axial, radial and tangential refer to the axis X of the turbomachine. An axial direction follows the axis X of the turbomachine, a radial direction is perpendicular to the axis X of the turbomachine and a tangential direction is orthogonal to a radial direction and an axial direction.

Figure 2:
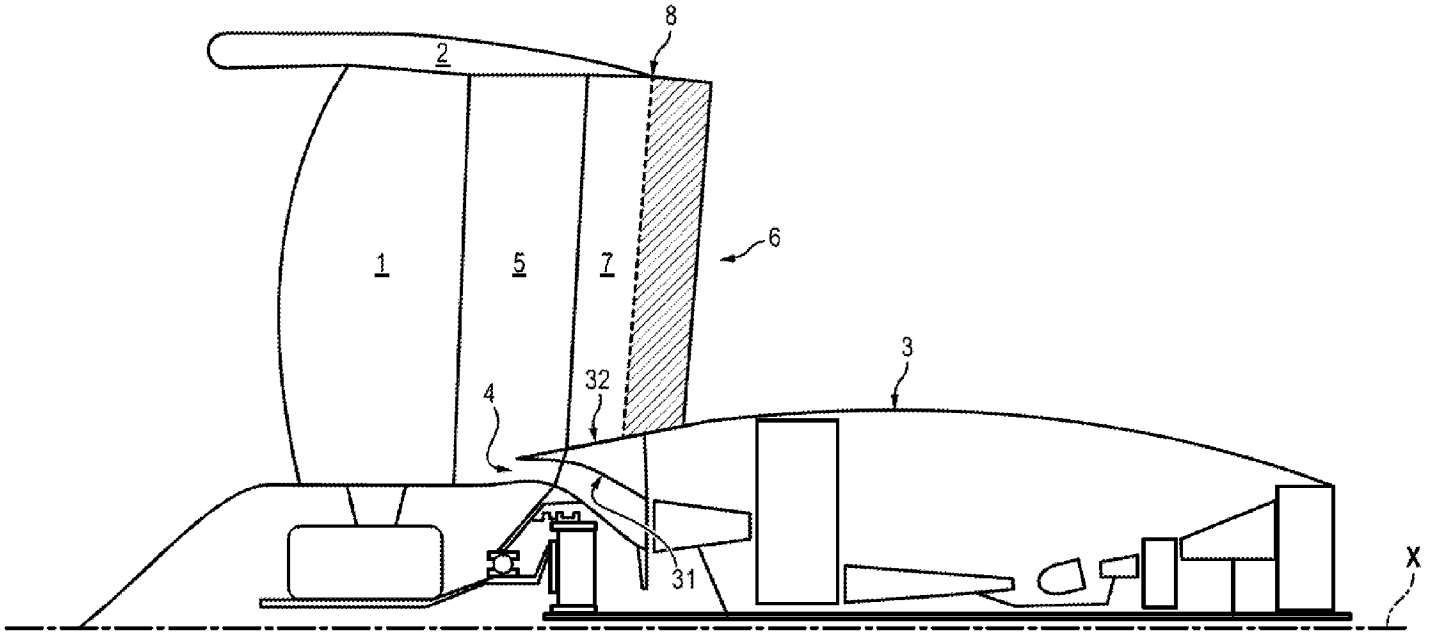
FIG. 2 is a schematic profile section view which shows an assembly including a nacelle and a secondary flow straightener according to the invention.

In the embodiment shown in FIG. 2, the turbomachine is a double flow turbomachine also including a fan 1, housed in a fan shroud 2, and movable in rotation around a longitudinal axis X, an inner ferrule 31 configured to delimit a primary duct 4 of a primary gas flow of the turbomachine, the ferrule 32 and the fan shroud 2 delimiting a so-called secondary stream duct of an air flow propelled by the fan 1.

In the embodiment shown, the ferrule 32 is located in the upstream continuation of the turbomachine casing 3.

In other embodiments, the ferrule 32 can be part of the casing 3, and thus form the upstream portion of the casing 3.

The ferrule 32 and the inner ferrule 31 can form only a single piece and form the leading edge of the casing 3.

Figure 3:
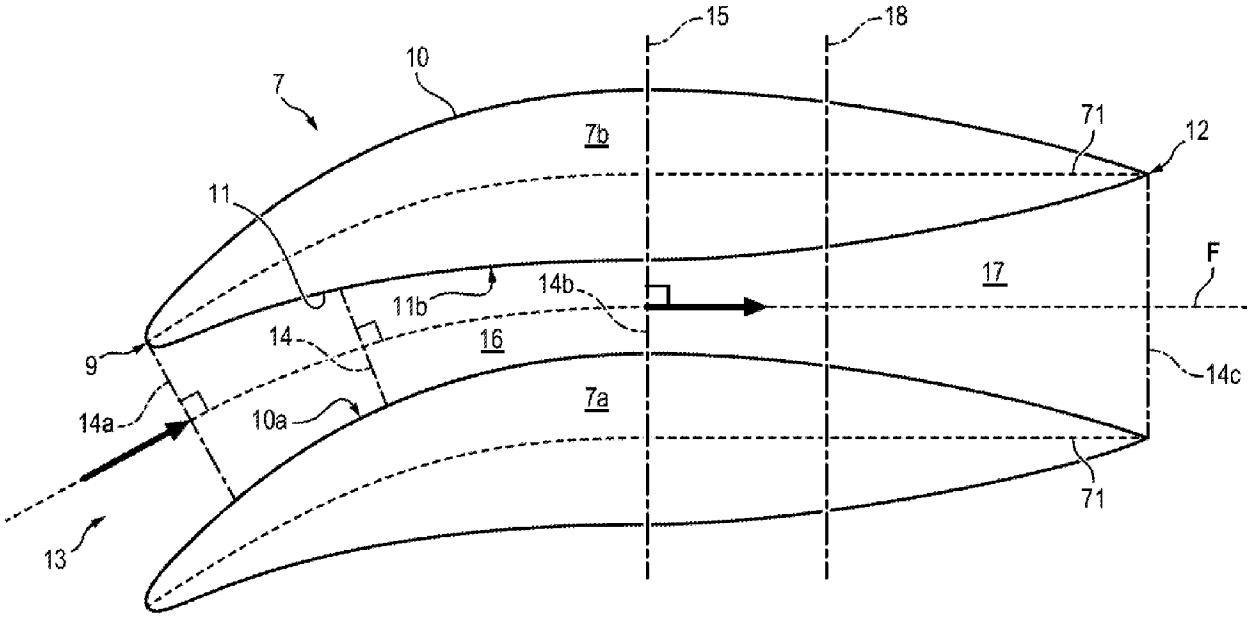
FIG. 3 is a projection onto a plane of a constant-radius section of two adjacent vanes of a straightener according to the invention.

In the embodiment shown in FIG. 3, each vane 7 comprises a leading edge 9, a trailing edge 12 opposite to the leading edge 9, and pressure side 11 and suction side 10 walls connecting the leading edge 9 to the trailing edge 12, and the stream channel 13 has, from upstream to downstream in the direction of fluid flow, an inlet section 14*a* extending from the first vane 7*a* to the second vane 7*b* in a mean stream direction and tangent to the leading edge 9 of one of the vanes 7, an ejection section 14*b* extending from the first vane 7*a* to the second vane 7*b* while being normal to a mean stream direction, and an outlet section 14*c* extending from the first vane 7*a* to the second vane 7*b* while being normal to a mean stream direction and tangent to the trailing edge 12 of at least one of the vanes 7.

The inlet section 14*a*, the ejection section 14*b* and the outlet section 14*c* extend respectively from the radially inner limit to the radially outer limit of the vanes 7.

The inlet section 14*a* thus corresponds to a radial section of the stream channel 13 which coincides with the leading edge 9 of the second vane 7*b*, and the ejection section 14*b* corresponds to a radial section extending downstream of the inlet section 14*a*.

The ejection section 14*b* has a surface area smaller than a surface area of the inlet section 14*a* and smaller than a surface area of the outlet section 14*c*.

This reduction in the cross section of the stream channel 13 allows accelerating the secondary flow as it circulates in the straightener 6.

The stream channel 13 has a radial section 14 which is defined as a virtual plane extending from the suction side wall 10*a* of the first vane 7*a* to the pressure side wall 11*b* of the second vane 7*b* while being normal to a mean stream direction at a central streamline F and extending substantially radially with respect to the longitudinal axis X.

What is meant by a central streamline is the streamline located equidistantly from the first vane 7*a* and from the second vane 7*b*.

The radial section 14 of the stream channel 13 has a surface area which decreases progressively between the inlet section 14*a* and the ejection section 14*b*.

More precisely, the radial section 14 has a width L defined as being a distance between the suction side 10*a* of the first vane 7*a* and the pressure side 11*b* of the second vane 7*b* for a constant distance from the axis X, and in which the width of the radial section 14 is decreasing along the circulation of the stream in the stream channel 13 between the inlet section 14*a* and the ejection section 14*b*.

In other words, the suction side wall 10*a* of the first vane 7*a* and the pressure side wall 11*b* of the second vane 7*b* are closer and closer to one another, for a given distance from the axis X, as the flow circulates from upstream to downstream in the stream channel 13.

This allows reducing the surface area of the radial section 14, which allows generating an acceleration of the flow.

This allows in particular reducing the surface are of the radial section 14 while avoiding strong variations of the profile of the fan shroud 2 and of the outer ferrule 32, so that perturbations and possible aerodynamic separations which can be generated by such variations are avoided.

In the embodiment shown, a radial section 14 has a shape comparable to an angular portion of a disk and has a dimension in a transvers direction and a dimension in a radial direction.

In the transverse direction, the radial section 14 is delimited by the first vane 7*a* and the second vane 7*b*.

The distance separating the first vane 7*a* and the second vane 7*b*, the width L, is a function of the distance to the axis X of the turbomachine at which the width L is considered. In fact, the distance between the first vane 7*a* and the second vane 7*b* increases with the distance to the axis X.

The result is that the width of a radial section 14 is a function of the radius or of a distance to the axis X of the turbomachine, and increases as a function of the distance to the axis X of the turbomachine.

In a radial direction, the radial section 14 is radially delimited internally by the outer ferrule 32 and extends over the entire height of a vane 7.

The radial section 14 has a radially internal limit and a radially external limit, each substantially forming a circular arc.

By moving the radial section 14 from upstream to downstream, the width L is reduced, and optionally the dimension in the radial direction is also reduced.

Thus, the reduction of the stream cross section 14 causes an expansion and therefore an acceleration of the secondary flow.

More precisely, the pressure side 11*a* of the first vane 7*a* and the suction side 10*b* of the second vane 7*b* are therefore configured so that the width L of a radial section 14, for a given distance to the axis X of the turbomachine, decreases with the downstream movement of the flow.

If a radial section 14 located downstream of the inlet section 14*a* is considered, the width L of the radial section 14 will be less than the width of the inlet section 14*a*.

It is obvious that, to compare the width of the inlet section 14*a* and the width L of the radial section 14, it is necessary that these two values be expressed for the same radius.

This width L can optionally be the length of a line segment joining the first vane 7*b* and the second vane 7*a* at mid-height.

Advantageously, for each radial section 14 between the inlet section 14*a* and the ejection section 14*b*, the length of the line segment joining the first vane 7*b* and the second vane 7*a* at mid-height decreases progressively between the inlet section 14*a* and the ejection section 14*b*.

The ejection 14*b* has the minimum surface area for a radial section 14.

In the embodiment shown, the width L of a radial section 14 decreases when moving from upstream to downstream until a median plane 15, the median plane 15 thus including the ejection section 14*b*.

In the embodiment shown, the median plane 15 is normal to the axis X of the turbomachine, and delimits the stream channel 13 into two portions, an upstream or intake portion 16 and a downstream or ejection portion 17.

If the radial section 14 is located in the intake portion 16, the transverse dimension of the radial section 14 is less than the transverse dimension of the inlet section 14*a* and greater than the transverse dimension of the ejection section 14*b*.

In other words, in the intake portion 16, the stream channel 13 is converging, the radial section 14 having a surface area that decreases from upstream to downstream.

This causes an expansion of the flow passing through the stream channel 13, and incidentally an acceleration of the flow.

The intake portion 16 of the stream channel 13 is configured to accomplish the work of modifying the flow direction and the acceleration of the flow.

The stream channel 13 thus has an inlet section 14*a* defining a plane normal (or orthogonal) to the stream direction of the flow deflected by the fan, this plane therefore not being normal to the axis X of the turbomachine, and an ejection section 14*b* defining a plane normal to the axis X of the turbomachine. This allows ejecting a flow circulating in a direction substantially parallel to the axis of the turbomachine.

In other words, the intake portion 16 straightens the flow while expanding it and while accelerating it until ejection at the median plane 15.

The ejection portion 17 is configured to minimize the aerodynamic drag of the straightener 6.

The incidence angle of the profile relative to the flow is small, so as to avoid separation of the air flow, while having the shortest length possible to minimize viscous friction.

A part of the ejection portion 17 is located downstream of the trailing edge 8 of the fan shroud 2. Thus, this allows slowing the flow in the ejection portion 17 until flight speed.

More specifically, downstream of the median plane 15, the profile of the vanes 7 is configured to minimize the drag of each vane 7, the vanes 7 therefore extending axially until their trailing edges 12.

The cross section of a van 7 downstream of the median plane 15, more particularly its dimension in the tangential direction, decreases downstream until its trailing edge 12, the reduction of the tangential dimension of the vane 7 being configured to limit aerodynamic separation.

Thus, the flows transiting the stream channels 13 located side by side join each other without aerodynamic separation.

The cross section of the flow channel 13 therefore increases downstream in the ejection portion 17.

Optionally, the vanes 7 have a camber line 71 which can include an inflection point, the camber line or mean line being defined in that it extends from the leading edge 9 to the trailing edge 12 and that it is at mid-distance from the suction side 10 and from the pressure side 11.

The camber line 71 has an inclination with respect to the axis X of the turbomachine corresponding to the swirl of the flow at the leading edge 9, and is substantially parallel to the engine axis of the median plane 15 at the trailing edge 12.

Advantageously, the median plane 15, and thus the ejection section 14*b*, coincides with the trailing edge 8 of the fan shroud. The ejection portion 17 is therefore not ducted. Thus, the length of the fan shroud 2 can be reduced to a minimum without penalizing the operation of the intake portion 16 which is ducted by the fan shroud 2, or the operation of the ejection portion 17, the only role of which is to reduce drag.

A portion of the vanes 7, particularly the trailing edge 12, is then located downstream of the trailing edge 8 of the fan shroud 2, and is therefore not ducted.

This allows minimizing the length of the fan shroud 2, and thereby minimizing the head losses induced by the fan shroud 2.

In one variant, the fan shroud 2 can continue axially beyond the median plane 15. In this configuration, the trailing edge 8 of the fan shroud 2 is situated downstream of the median plane 15 and upstream of the trailing edges 12 of the vanes, at a duct plane 18. This configuration allows forming a converging, then diverging profile in the ducted (i.e. covered by the fan shroud 2) portion of the stream channels 13. This allows improving performance, depending on the flight envelope.

Advantageously, each pair of adjacent vanes 7 of the straightener 6 defines a flow channel 13 configured to straighten and simultaneously to accelerate the flow, the vanes of the straightener 6 thus defining a plurality of stream channels 13 distributed circumferentially.

This allows accelerating the flow homogeneously over the entire circumference of the straightener 6.

In an assembly of this type, the absence of a nozzle formed by the fan shroud 2 and the ferrule 32 is compensated by the expansion effect of the straightener 6, more particularly by the expansion work accomplished by the intake portion 16 of the stream channels 13.

Head losses are reduced by the reduction of the length of the fan shroud 2 and the profile of the vanes 7, more particularly the trailing edge 12 and the profile of the ejection portion 17 allowing reducing the drag and thus limiting separation and head losses.

An assembly of this type thus allows straightening and accelerating the flow transiting in the stream channels 13, unlike conventional flow deflection elements.

Conventional straighteners straighten the flow and slow it down.

Conventional guide nozzles accelerate the flow while deflecting it, i.e. the flow arrives in the guide nozzle with a stream direction substantially parallel with the axis X of the turbomachine and leaves the guide nozzle with a stream direction that is inclined relative to the axis of the turbomachine.

Conventional nozzles form a converging channel which accelerates the flow without deflecting it.

In addition, the profile of the vanes 7 terminating with a trailing edge allows avoiding flow separation at the outlet of the assembly.

The invention claimed is:

1. An assembly for a turbomachine extending along an axis, the assembly comprising:

a ferrule delimiting a fan duct the turbomachine;

a fan shroud radially surrounding the ferrule and delimiting with the ferrule the fan duct; and a straightener comprising a plurality of vanes configured to straighten a flow circulating in the fan duct, wherein the plurality of vanes comprises a first vane and a second vane adjacent to the first vane, the first vane and the second vane delimiting between them a converging stream channel configured to straighten and accelerate the flow by means of an inlet section comprised in a plane that is not perpendicular to the axis of the turbomachine and an outlet section comprised in a plane perpendicular to the axis of the turbomachine, the first vane and the second vane each having an unducted portion forming a trailing edge, the unducted portion being downstream with reference to the flow.

2. The assembly according to claim 1, wherein the converging stream channel comprises; from upstream to downstream with reference to the flow:

an intake portion narrowing from upstream to downstream; and ejection portion widening from upstream to downstream.

3. The assembly according to claim 1, wherein the first vane has a first surface, the second vane has a second surface facing the first surface, the first surface approaching the second surface from upstream to downstream with reference to the flow.

4. The assembly according to claim 1, wherein the fan shroud extends around a longitudinal axis and comprises a downstream end with reference to the flow, the downstream end forming a trailing edge, and wherein the ejection portion extends downstream of the trailing edge of the fan shroud.

5. The assembly according to claim 1, wherein a camber line of each vane has an inflection point.

6. The assembly according to claim 1, wherein each vane comprises:

a leading edge;

a trailing edge opposite to the leading edge; and pressure side and suction side walls connecting the leading edge to the trailing edge, the stream channel having from upstream to downstream in the stream direction of the flow:

an inlet section extending from the first vane to the second vane while being normal to a mean stream direction and tangent to the leading edge of one of the vanes, the inlet section having a first area;

an ejection section extending from the first vane to the second vane while being normal to a mean stream direction, the ejection section having a second area; and an outlet section extending from the first vane to the second vane while being normal to a mean stream direction and tangent to the trailing edge of at least one of the vanes, the outlet section having a third area, and in which the first area is greater than the second area, the second area being less than the third area.

7. The assembly according to claim 1, wherein the stream channel has:

an inlet section defining a plane normal to the stream direction of the flow deflected by the fan, the plane not being parallel to the axis of the turbomachine; and an ejection section defining a plane normal to the axis of the turbomachine.

8. The assembly according to claim 1, wherein the fan shroud continues axially beyond the median plane, a trailing edge of the fan shroud being located with reference to the flow downstream of the median plane and upstream of the trailing edges of the vanes at a duct plane.

9. A turbomachine including an assembly, the assembly extending along an axis, the assembly comprising:

a ferrule delimiting a fan duct of the turbomachine;

a fan shroud radially surrounding the ferrule and delimiting with the ferrule the fan duct; and a straightener comprising a plurality of vanes configured to straighten a flow circulating in the fan duct, wherein the plurality of vanes comprises a first vane and a second vane adjacent to the first vane, the first vane and the second vane delimiting between them a converging stream channel configured to straighten and accelerate the flow by means of an inlet section comprised in a plane that is not perpendicular to the axis of the turbomachine and an outlet section comprised in a plane perpendicular to the axis of the turbomachine, the first vane and the second vane each having an unducted portion forming a trailing edge, the unducted portion being downstream with reference to the flow.

* * * * *